US008155566B2

(12) United States Patent
Yoshikawa et al.

(10) Patent No.: US 8,155,566 B2
(45) Date of Patent: Apr. 10, 2012

(54) TONER FEED UNIT WITH SHUTTER ASSEMBLY AND IMAGE FORMING APPARATUS EQUIPPED WITH THE SAME

(75) Inventors: Yoshihiro Yoshikawa, Osaka (JP); Koichi Mihara, Osaka (JP); Yuhsuke Yoshimoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 351 days.

(21) Appl. No.: 12/534,290

(22) Filed: Aug. 3, 2009

(65) Prior Publication Data

US 2010/0054816 A1 Mar. 4, 2010

(30) Foreign Application Priority Data

Aug. 27, 2008 (JP) ..... 2008-217495

(51) Int. Cl.
*G03G 15/08* (2006.01)

(52) U.S. Cl. ..... 399/260

(58) Field of Classification Search ..... 399/119, 399/120, 258, 260, 262
See application file for complete search history.

(56) References Cited

U.S. PATENT DOCUMENTS

| | | | | |
|---|---|---|---|---|
| 5,608,501 | A * | 3/1997 | Makino | 399/119 |
| 2009/0060586 | A1 * | 3/2009 | Ishiguro et al. | 399/238 |

FOREIGN PATENT DOCUMENTS

| | | | |
|---|---|---|---|
| JP | 6-035318 | A | 2/1994 |
| JP | 8-286490 | A | 11/1996 |
| JP | 2000-098713 | A | 4/2000 |
| JP | 2006-259228 | A | 9/2006 |
| JP | 2007-78848 | A | 3/2007 |

* cited by examiner

*Primary Examiner* — David Gray
*Assistant Examiner* — Billy J Lactaoen
(74) *Attorney, Agent, or Firm* — Nixon & Vanderhye P.C.

(57) ABSTRACT

A toner feed unit includes: a first feed portion having a first feed pipe for forming a first toner feed passage having a rectangular section and a first shutter member constructed so as to be rotatable about an axis perpendicular to the feed direction of the first toner feed passage and open and close the toner output end of the first toner feed passage; and a second feed portion having a second feed pipe for forming a second toner feed passage having a rectangular section and a second shutter member constructed so as to be rotatable about an axis perpendicular to the feed direction of the second toner feed passage and open and close the toner input end of the second toner feed passage.

6 Claims, 6 Drawing Sheets

TONER FEED UNIT WITH SHUTTER ASSEMBLY AND IMAGE FORMING APPARATUS EQUIPPED WITH THE SAME

This Nonprovisional application claims priority under 35 U.S.C. §119 (a) on Patent Application No. 2008-217495 filed in Japan on 27 Aug. 2008, the entire contents of which are hereby incorporated by reference.

BACKGROUND OF THE TECHNOLOGY (1) Field of the Technology

The present technology relates to a toner feed unit used in conveying toner to a predetermined position and an image forming apparatus equipped with this.

(2) Description of the Prior Art

The electrophotographic image forming apparatus can form images of high image quality with simple control in a short time and it also enables easy maintenance and management, so that it has been widely used as the copier, printer, facsimile machine and the like, for instance. The electrophotographic image forming apparatus (which will be referred to hereinbelow as simply "image forming apparatus"), includes, for example, a photoreceptor, a charging device, an exposure device, a developing device, a transfer device and a fusing device. The photoreceptor has a photosensitive layer on the surface thereof, which is electrified at a predetermined surface potential by the charging device. The exposure device emits signal light in accordance with image information onto the photoreceptor surface that has been electrified to form an electrostatic latent image. The developing device supplies toner to the electrostatic latent image on the photoreceptor surface to develop it into a toner image. The transfer device transfers the toner image from the photoreceptor surface to a recording medium. The fusing device includes, for example, a fusing roller incorporating a heater and a pressing roller put in press-contact with the fusing roller, and leads the recording medium having an unfused toner image thereon into the contact nip between the fusing roller and pressing roller to fuse and fix the toner image to the recording medium. In this way, the image is printed on the recording medium.

The developing device includes a developing roller arranged opposing the photoreceptor that is formed with an electrostatic latent image while rotating, and a developing vessel for holding a developer. The developing device conveys the developer inside the developing vessel to the photoreceptor side by means of the developing roller to thereby develop the electrostatic latent image on the photoreceptor. At this time, when the developer is a dual-component developer made of a toner and a carrier, only the toner is used and consumed for development while the carrier is left inside the developing vessel. The consumed amount of toner is supplied from a toner cartridge or toner hopper to the developing vessel through a toner feed unit.

There are known toner feed unit configurations which are constructed such that toner is prevented from dropping when the developing vessel is removed from the interior of the image forming apparatus to replace the developer. For example, in the image forming apparatus disclosed in patent document 1 (Japanese Patent Application Laid-open 2007-78848), an openable and closable shutter is provided in the supply port of the toner supply unit such that the shutter is closed by operating a lever that is in linkage with the shutter when the developing vessel is taken out from the image forming apparatus, whereas the shutter is opened when the developer vessel is fitted to the predetermined position in the image forming apparatus.

However, the above method suffers the problem that toner adheres to the outside surface of the shutter and the adhering toner falls and scatters.

SUMMARY OF THE TECHNOLOGY

It is therefore an object of the present technology to provide a toner feed unit which is free from toner leakage and toner scattering into the image forming apparatus when the developing unit is removed, as well as to provide an image forming apparatus equipped with this.

In order to solve the above problem, the toner feed unit of the present technology, a toner feed unit of the present technology includes: a first feed portion including: a first toner feed passage provided therein; and a first shutter member that is constructed so as to be rotatable about an axis perpendicular to the toner feed direction of the first toner feed passage and so as to be able to open and close the toner output end of the first toner feed passage; and, a second feed portion including: a second toner feed passage that is provided therein to be able to join to the first toner feed passage; and a second shutter member that is constructed so as to be rotatable about an axis perpendicular to the toner feed direction of the second toner feed passage and so as to be able to open and close the toner input end of the second toner feed passage that is connected to the toner output end of the first toner feed passage, and is characterized in that when the first feed portion and second feed portion are separated from each other, the first shutter member and the second shutter member are rotated and set into their close states, and when the first feed portion and second feed portion are joined to feed toner, the first toner feed passage and the second toner feed passage are set into communication with each other by integrally rotating the first shutter member and the second shutter member to open the first shutter member and the second shutter member.

In accordance with this technology, since the first shutter member that is located at the toner output end of the first toner feed passage and the second shutter member that is located at the toner input end of the second toner feed passage rotate adjacently in contact with each other, no toner will adhere to the contact portions so that it is possible to prevent the toner, which would adhere to the outside of each shutter member, from scattering inside the apparatus when the first and second feed portions are separated from each other.

In order to solve the above problem, the toner feed unit of the present technology is characterized in that the first shutter member includes a lever, and when the first shutter member and the second shutter member are set to be open, the first shutter member and the second shutter member are integrally rotated in contact with other as the lever is pressed and placed inside the second toner feed passage.

In accordance with this technology, even if the first shutter member is put into the second toner feed passage to open the first toner feed passage, no toner will adhere to the contact portions of first shutter member and the second shutter member, so that it is possible to prevent the toner, which would adhere to the outside of each shutter member, from scattering inside the apparatus when the first and second feed portions are separated from each other.

In order to solve the above problem, the toner feed unit of the present technology is characterized in that the second feed portion includes a pressing member, and when the first feed portion and the second feed portion are joined to each other, the pressing member presses in contact with the lever in such a direction as to rotate the first shutter member and the second shutter member and open the first and second shutter members.

In accordance with this technology, when the first toner feed passage and the second toner feed passage are jointed, the pressing member is actuated so as to automatically open the first toner feed passage and the second toner feed passage.

In order to solve the above problem, the toner feed unit of the present technology is characterized in that the lever has an arced shape, and the lever is located outside the joint when the first feed portion and the second feed portion are jointed.

In accordance with this technology, it is possible to join the first feed portion and the second feed portion by the sliding movement in the lateral direction which will not cause interference with the arced lever.

In order to solve the above problem, the toner feed unit of the present technology is characterized in that the first toner feed passage and the second toner feed passage are formed of resin material containing a conductive substance.

In accordance with this technology, since toner is unlikely to adhere to the first toner feed passage and the second toner feed passage, it is possible to make the first shutter member and the second shutter member open and close smoothly.

In order to solve the above problem, the toner feed unit of the present technology is characterized in that the surfaces of the first toner feed passage and the second toner feed passage have a ten point mean roughness Rz of 2 μm or lower.

In accordance with this technology, since toner bridge is unlikely to form inside the first toner feed passage and the second toner feed passage, toner can be smoothly supplied.

In order to solve the above problem, the toner feed unit of the present technology is characterized in that the first shutter member is provided with a sealing element.

In accordance with this technology, it is possible to prevent toner from dropping through gaps due to vibration in a state where the first toner feed passage is closed by the first shutter member.

In order to solve the above problem, the image forming apparatus of the present technology reside in an image forming apparatus forming an image by transferring a developed toner image to a recording medium and fixing the toner image thereto, comprising: a toner cartridge for reserving toner; and a developing device for developing an electrostatic latent image formed on the photoreceptor surface with toner, and is characterized in that the toner feed unit having any one of the above features is used to supply toner from the toner cartridge to the developing device.

In accordance with this technology, since the first and second shutter members rotate with their outer sides put in contact with each other, no toner will adhere to them. Accordingly it is possible to prevent the toner, which would adhere to the outside of each shutter member, from scattering inside the apparatus when the first and second feed portions are separated.

According to the present technology, the first shutter member that is located at the toner output end of the first toner feed passage and the second shutter member that is located at the toner input end of the second toner feed passage rotate adjacently in contact with each other. Accordingly, no toner will adhere to the contact portions, so that it is possible to prevent the toner, which would adhere to the outside of each shutter member, from scattering inside the apparatus when the first and second feed portions are separated.

DESCRIPTION OF THE PREFERRED EMBODIMENTS

The embodiment of the present technology will hereinafter be described with reference to the accompanying drawings.

Figure 1:
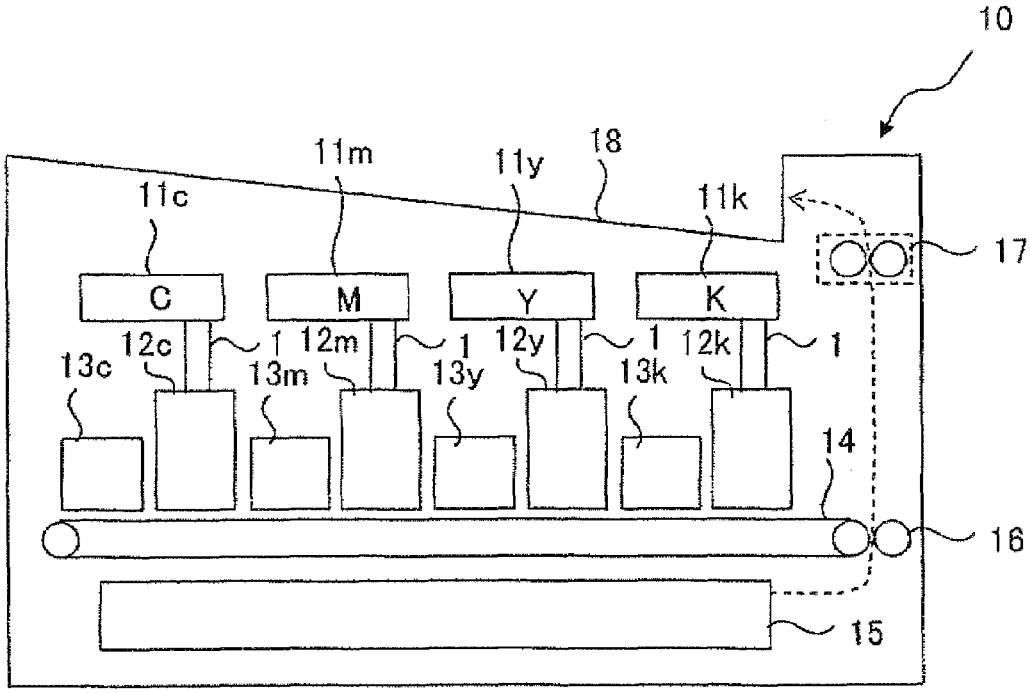
FIG. 1 is a front sectional view schematically showing a configuration of an image forming apparatus as one embodiment mode of the present technology.

FIG. 1 is a front sectional view schematically showing a configuration of an image forming apparatus 10 as one embodiment mode of the present technology. The image forming apparatus of the present embodiment can form a full-color image in combination of four colors, cyan (C), magenta (M), yellow (Y) and black (K). The image forming apparatus employs a tandem type intermediate transfer system in which photoreceptor units for these colors are arranged in the order of CMYK and the developed toner images of these colors are successively transferred one over another onto an intermediate transfer belt.

Image forming apparatus 10 includes a cyan toner cartridge 11*c* for holding cyan toner (C), a magenta toner cartridge 11*m* for holding magenta toner (M), an yellow toner cartridge 11*y* for holding yellow toner (Y) and a black toner cartridge 11*k* for holding black toner (K).

Image forming apparatus 10 includes, in the lower position of respective toner cartridges 11 (11*c*, 11*m*, 11*y* and 11*k*), a cyan developing device 12*c* for holding a cyan developer, a magenta developing device 12*m* for holding a magenta developer, an yellow developing device 12*y* for holding an yellow developer and a black developing device 12*k* for holding a black developer.

Each developing device 12 (12*c*, 12*m*, 12*y*, 12*k*) is coupled with associated toner cartridge 11 (11*c*, 11*m*, 11*y*, 11*k*) by the intermediary of a toner feed unit 1 so that toner is supplied from toner cartridge 11 to developing device 12. The detailed configuration of toner feed unit 1 will be described later.

Arranged at the adjacent position of each developing device 12 (12*c*, 12*m*, 12*y*, 12*k*) is a cyan photoreceptor unit 13*c*, a magenta photoreceptor unit 13*m*, an yellow photoreceptor unit 13*y* or a black photoreceptor unit 13*k*, each including a photoreceptor drum. The electrostatic latent image formed on each photoreceptor drum is developed so as to form the associated color toner image.

An endless intermediate transfer belt 14 that is rotatably wound and tensioned between two supporting rollers is arranged under photoreceptor units 13 (13*c*, 13*m*, 13*y* and 13*k*). The toner image on each photoreceptor drum is adapted to be transferred to intermediate transfer belt 14.

Arranged under intermediate transfer belt 14 is a paper feed cassette 15. The paper stacked in paper feed cassette 15 is supplied toward the transfer position located at one end of intermediate transfer belt 14. A transfer roller 16 is disposed at the transfer position of intermediate transfer belt 14. A voltage having a polarity opposite to the polarity of the static charge on the toner is applied to transfer roller 16 so as to transfer the toner image on intermediate transfer belt 14 to the surface of the paper that is fed to the transfer position.

Arranged over transfer roller 16 is a fusing unit 17, which heats the toner image transferred on the paper surface to fix it to the paper.

A paper output tray 18 is formed on the top of image forming apparatus 10. This paper output tray 18 receives the paper discharged from image forming apparatus 10.

Figure 2:
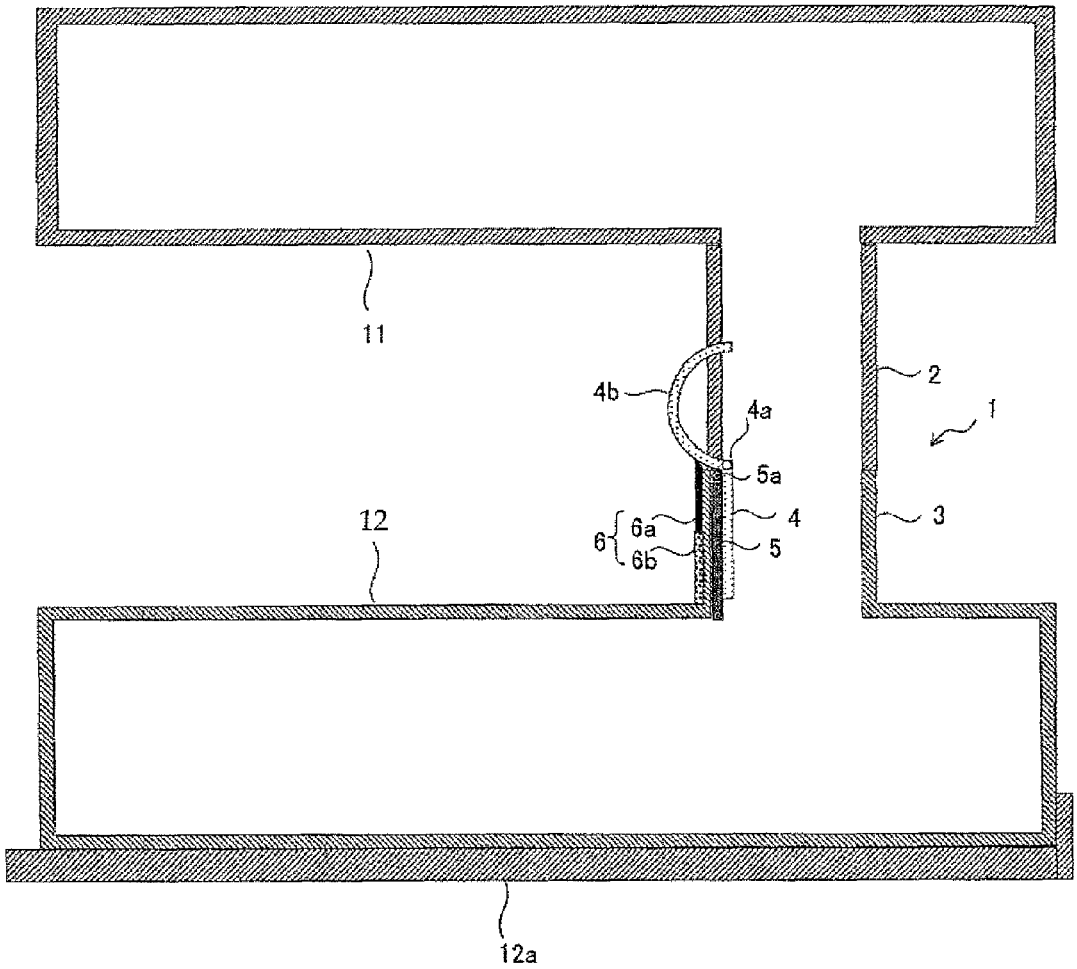
FIG. 2 is a sectional view showing the configuration of a toner feed unit and its surroundings viewed from the right side in FIG. 1.

FIG. 2 is a sectional view showing the configuration of toner feed unit 1 and its surroundings viewed from the right side in FIG. 1.

In FIG. 2, toner cartridge 11 and developing device 12 are coupled to each other by way of toner feed unit 1, so that toner is supplied from toner cartridge 11 to developing device 12.

This developing device 12 is provided on a developing device table 12*a* in a slidable manner in the lateral direction (in the direction perpendicular to the intermediate transfer belt 14's direction of travel: the width direction of intermediate transfer belt 14). In FIG. 2, developing device 12 is constructed so as to be removed from the interior of image forming apparatus 10 by sliding it leftwards.

Toner feed unit 1 includes a first feed pipe 2, a second feed pipe 3, a first shutter member 4 and a second shutter member 5.

First feed pipe 2 has a first toner feed passage having a rectangular section formed therein.

First shutter member 4 is constructed so as to be rotatable on an axis (rotary axis 4*a*) that extends perpendicularly to the direction of toner conveyance through the first toner feed passage and open and close one end (toner output end) of the first toner feed passage.

First feed pipe 2 and first shutter member 4 constitute the first feed portion.

Second feed pipe 3 has a second toner feed passage having a rectangular section formed therein.

Second shutter member 5 is constructed so as to be rotatable on a rotary axis 5*a* that extends perpendicularly to the direction of toner conveyance through the second toner feed passage and open and close one end (toner input end) of the second toner feed passage.

Second feed pipe 3 and second shutter member 5 constitute the second feed portion.

First shutter member 4 and second shutter member 5 are arranged so as to be able to rotate in an integrated manner when first feed pipe 2 and second feed pipe 3 are coupled in the predetermined position. This will be detailed later.

A pressing member 6 is provided at a position where it can come in contact with first shutter member 4.

Pressing member 6 includes a pressing piston 6*a*, a pressing cylinder 6*b* and a pressing spring 6*c* (FIG. 6) and is disposed on the outer side of second feed pipe 3.

Pressing member 6 presses and rotates first shutter member 4 in such a direction as to cause the toner output end of the first toner feed passage to open when first feed pipe 2 and second feed pipe 3 are joined in the predetermined position.

Pressing piston 6*a* is urged by pressing spring 6*c* inside pressing cylinder 6*b* in such a direction as to be projected from pressing cylinder 6*b*. The urging direction of pressing piston 6*a* is directed opposite the direction of toner conveyance through the first and second toner feed passages.

In this way, pressing member 6 is actuated when first and second feed pipes 2 and 3 are jointed so as to automatically open first feed pipe 2 and second feed pipe 3.

Figure 3:
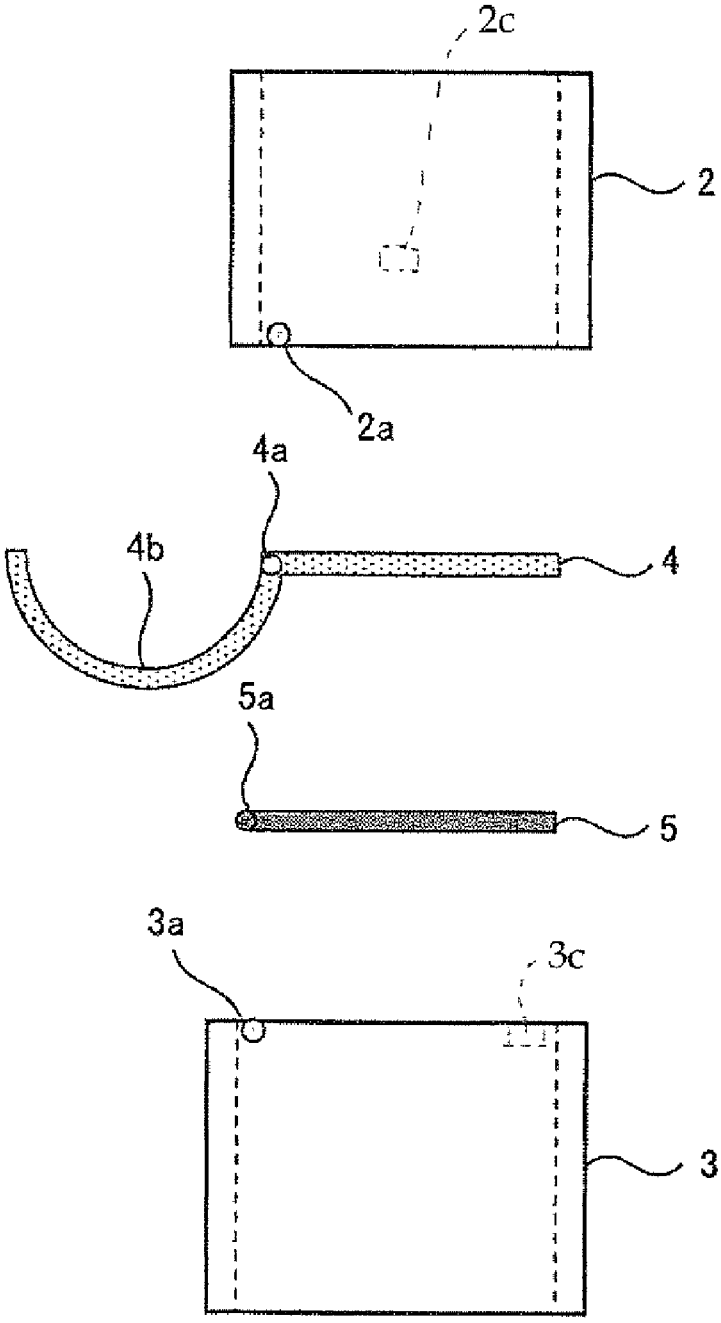
FIG. 3 is an exploded side view showing parts of a toner feed unit.
Figure 4:
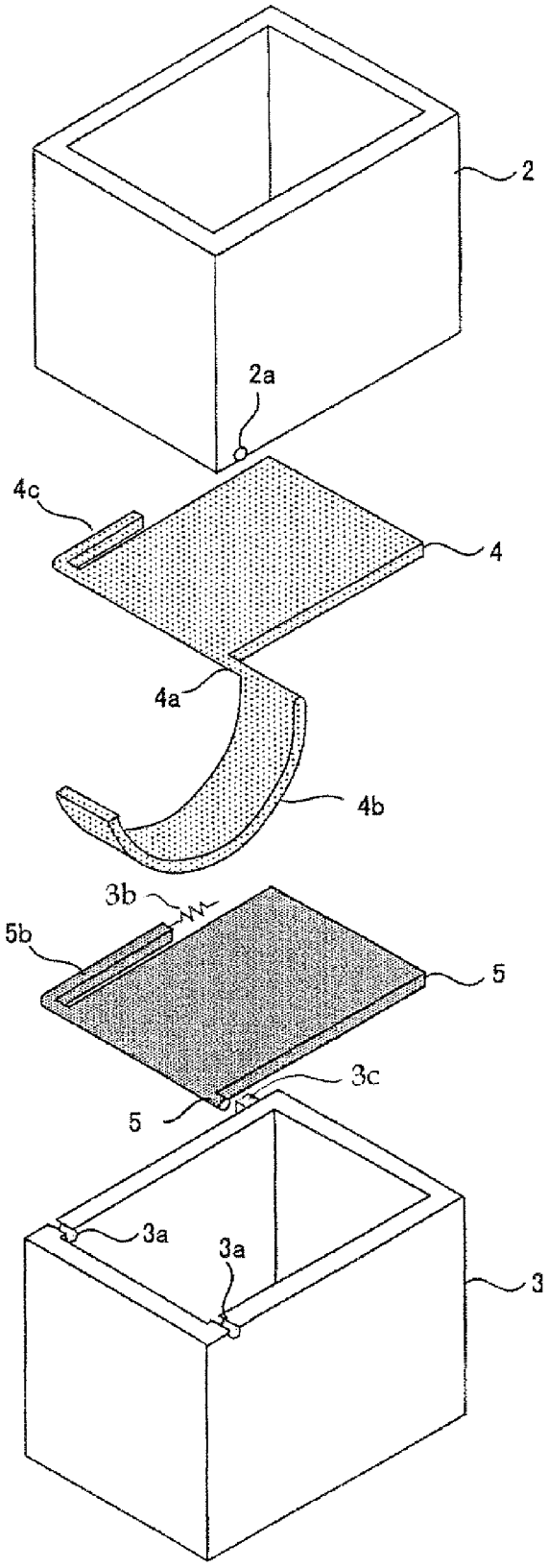
FIG. 4 is a perspective exploded view showing parts of a toner feed unit.

FIGS. 3 and 4 are exploded views of the parts of toner feed unit 1, FIGS. 3 and 4 being side and perspective views, respectively.

As shown in FIGS. 3 and 4, first shutter member 4 is formed of a rectangular plate for closing the first toner feed passage, and includes a rotary axis 4*a*, an arced lever 4*b* and a hook 4*c*.

As shown in FIG. 4, arced lever 4*b* is formed outside the flank of first feed pipe 2 so as to permit the sliding movement of first feed pipe 2 and second feed pipe 3 in the lateral direction (the direction perpendicular to the intermediate transfer belt 14's direction of travel: the width direction of intermediate transfer belt 14), which will not cause interference with arced lever 4*b*, when first feed pipe 2 and second feed pipe 3 are jointed.

Second shutter member 5 is formed of a rectangular plate for closing the second toner feed passage, and includes a rotary axis 5*a* and a hook 5*b*.

Axis sockets 2*a* and 3*a* are formed in the vicinity of the toner outlet end and the toner input end of first feed pipe 2 and second feed pipe 3, so as to rotatably support rotary axis 4*a* of first shutter member 4 and rotary axis 5*a* of second shutter member 4, respectively.

First feed pipe 2 has a supporting piece 2*c* (FIGS. 3 and 6) formed at the toner outlet end, on the surface where hook 4*c* is arranged when first shutter member 4 is assembled, and on the upstream side of axis socket 2*a* with respect to the direction of toner conveyance and an extension spring 2*b* (FIG. 6) that couples supporting piece 2*c* and hook 4*c*. Extension spring 2*b* constantly urges first shutter member 4 in such a direction that first shutter member 4 will close the toner output end of first feed pipe 2.

Second feed pipe 3 has a supporting piece 3*c* (FIGS. 3 and 4) formed at the toner input end, on the surface where hook 5*b* is arranged when second shutter member 5 is assembled, and at the same height as, and on the side opposite, axis socket 3*a*, and an extension spring 3*b* that couples supporting piece 3*c* and hook 5*c*. Extension spring 3*b* constantly urges second shutter member 5 in such a direction that second shutter member 5 will close the toner input end of second feed pipe 3.

First feed pipe 2, second feed pipe 3, first shutter member 4 and second shutter member 5 are molded of resin, preferably containing conductive material such as carbon black and the like. If electrostatic attractive force takes place when each shutter member touches toner particles, the toner particles will build up on the shutter and hinder toner conveyance. However, since each shutter member etc. contains conductive material, it is possible to suppress occurrence of electrostatic attraction and realize easy toner feed. In addition, since toner is unlikely to adhere to first feed pipe 2 and second feed pipe 3, it is possible to make first shutter member 4 and second shutter member 5 open and close smoothly.

The amount of the conductive material is preferably 3 to 30 parts by weight in 100 parts by weight of the molding resin. If the amount of the conductive material is less than 3 parts by weight, occurrence of electrostatic attractive force cannot be sufficiently inhibited. If the amount is greater than 30 parts by weight, the moldability becomes worse.

Additionally, it is preferred that the surfaces of first feed pipe 2, second feed pipe 3, first shutter member 4 and second shutter member 5 each have a ten point means roughness (Rz) of 2 μm or lower. The mean particle size of the toner used in electrophotography is micronized, and it has been known from the particle size distribution of the toner to be used that there exist toner particles having a diameter of about 2 μm. If each member has a surface roughness of 2 μm or greater, micronized toner particles enter bumpy surface and physically adhere to the surface, resultantly causing toner aggregation on the surface of the member. Specifying the surface roughness of each member to be 2 μm or lower, makes it possible to suppress adhesion of toner to the surface of the member and ease toner feed. To suppress the ten point means roughness Rz of each member to be equal to or lower than 2 μm, the surface of each member should be polished with an abrasive having a particle size of 1 μm or less, for example.

Further, it is also possible to prevent toner leakage by providing a sealing element around first toner member 4. The sealing element herein is a member that is formed of flexible material such as rubber, sponge, etc., and applied around the shutter member in order to prevent toner leakage from cracks around the shutter.

FIGS. 5A to 5D are enlarged views of toner feed unit 1 for illustrating the open/closed states of first shutter member 4 and second shutter member 5, showing how second feed pipe 3 of toner feed unit 1 is coupled with first feed pipe 2 when developing device 12 is slid rightwards in FIG. 5 to be mounted to the predetermined position inside image forming apparatus 10 (FIG. 1).

Figure 5A:
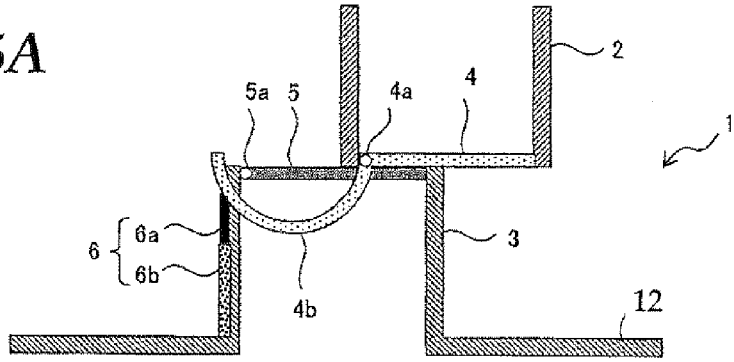
FIGS. 5A to 5D are enlarged views of a toner feed unit for illustrating the open/closed states of a first shutter member and a second shutter member.

FIG. 5A shows a state where second feed pipe 3 is moving toward the coupling position with first feed pipe 2. In this figure, the free end side of pressing piston 6*a* of pressing member 6 provided on the second feed pipe 3 side begins to abut arced lever 4*b* of first shutter member 4.

Figure 5B:
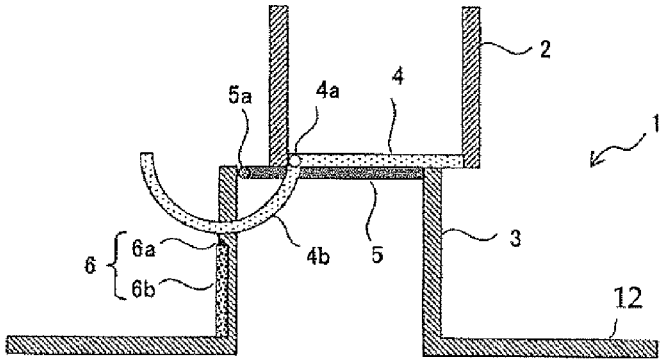

FIG. 5B shows a state where second feed pipe 3 is further moving toward the coupling position with first feed pipe 2, from the state shown in FIG. 5A. In this figure, pressing piston 6*a* of pressing member 6 is pushed (contracted) into pressing cylinder 6*b* along the shape of arced lever 4*b*, opposing the urging force. In this state, first shutter member 4 is constrained from rotating by second feed pipe 3, so that first feed pipe 2 will not be opened.

Figure 5C:
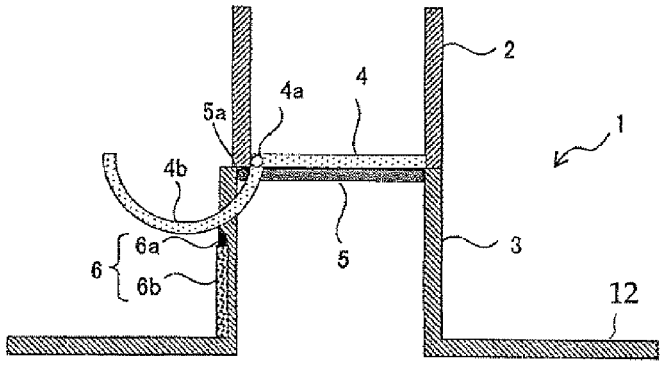

FIG. 5C shows a state where second feed pipe 3 has reached the coupling position with first feed pipe 2. In this figure, pressing piston 6*a* is pushing arced lever 4*b*. In this state, first shutter member 4 begins to rotate.

Figure 5D:
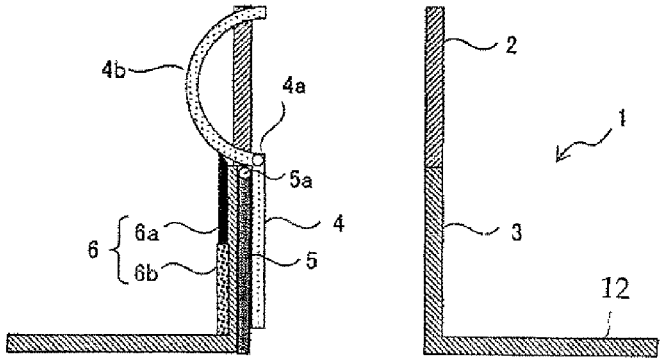

FIG. 5D shows a state where arced lever 4*b* is pushed in the direction opposite to the direction of toner feed through the first and second toner feed passages, by the pressing force (urging force) of pressing piston 6*a*, so that first shutter member 4 and second shutter member 5 integrally rotate about rotary axes 4*a* and 5*a* toward the toner feed direction side to open first feed pipe 2 and second feed pipe 3.

At this time, first shutter member 4 is kept in contact with second shutter member 5, so that it is possible to prevent adherence of toner to the contact surfaces.

When developing device 12 that is set in the predetermined position inside image forming apparatus 10 is slid out leftwards in FIG. 5D, first shutter member 4 rotates in the direction opposite to the direction of toner feed through the first and second toner feed passages, as receiving the rotational moment from the vicinity of rotary axis 5*a* of second shutter member 5, to thereby close first feed pipe 2.

Figure 6:
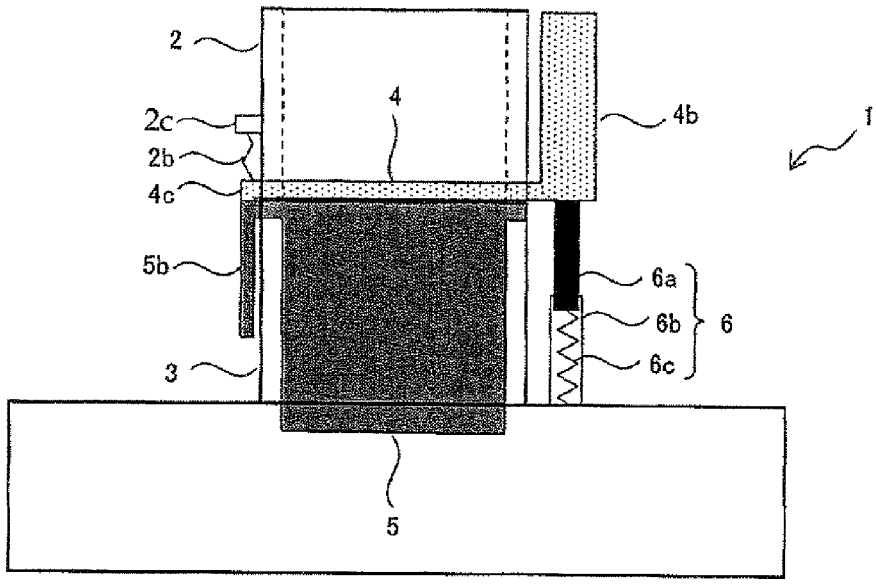
FIG. 6 is a left side view in FIG. 5D.

FIG. 6 is a left-side view (viewed from the same direction as in FIG. 1) in FIG. 5D. In this figure, arced lever 4*b* is pushed by the pressing force of pressing piston 6*a*, so that first shutter member 4 and second shutter member 5 integrally rotate about rotary axes 4*a* and 5*a* toward the toner feed direction side to open first feed pipe 2 and second feed pipe 3.

Figure 7:
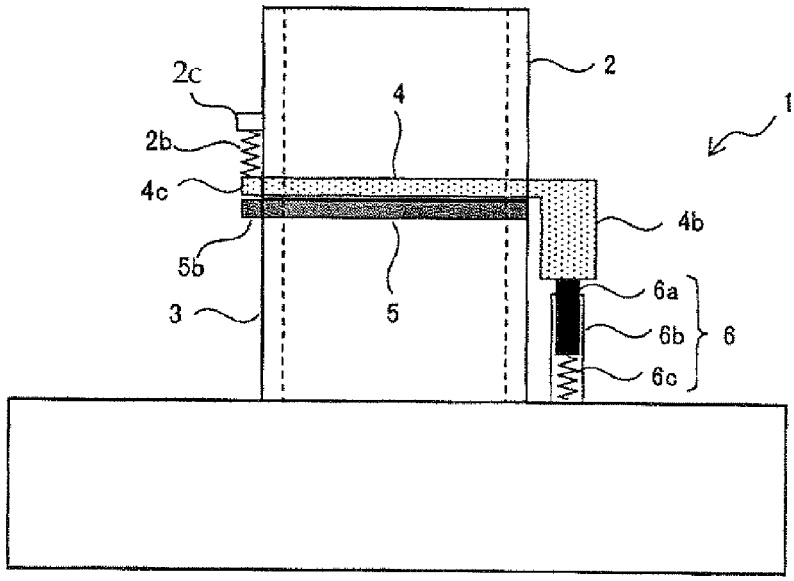
FIG. 7 is a left side view in FIG. 5C.

FIG. 7 is a left-side view (viewed from the same direction as in FIG. 1) in FIG. 5C. In this figure, first shutter member 4 rotates, as receiving the rotational moment from the vicinity of rotary axis 5*a* of second shutter member 5, to thereby close first feed pipe 2.

Hook 4*c* provided for first shutter member 4 is constantly urged by extension spring 2*b* in such a direction that first shutter member 4 will close one end (toner output end) of the first toner feed passage. Accordingly, when second feed pipe 3 has been completely apart from first feed pipe 2, first shutter member 4 can be kept to close first feed pipe 2. Similarly, hook 5*b* provided for second shutter member 5 is constantly urged by extension spring 3*b* in such a direction that second shutter member 5 will close one end (toner input end) of the second toner feed passage. Accordingly, when second feed pipe 3 has been completely apart from first feed pipe 2, second shutter member 5 can be kept to close second feed pipe 3.

In the above way, first shutter member 4 that is located at the toner output end of first feed pipe 2 and second shutter member 5 that is located at the toner input end of second feed pipe 3 rotate adjacently in contact with each other. Accordingly, no toner will adhere to the contact portions, so that it is possible to prevent the toner, which would adhere to the outside of each shutter member, from scattering inside the apparatus when the first and second feed portions are separated from each other.

What is claimed is:

1. A toner feed unit comprising:

a first feed portion including:

a first toner feed passage provided therein; and a first shutter member that includes a lever and that is constructed so as to be rotatable about an axis perpendicular to the toner feed direction of the first toner feed passage and so as to be able to open and close the toner output end of the first toner feed passage; and, a second feed portion including:

a second toner feed passage that is provided therein to be able to join to the first toner feed passage;

a second shutter member that is constructed so as to be rotatable about an axis perpendicular to the toner feed direction of the second toner feed passage and so as to be able to open and close the toner input end of the second toner feed passage that is connected to the toner output end of the first toner feed passage; and a pressing member, characterized in that when the first feed portion and second feed portion are separated from each other, the first shutter member and the second shutter member are rotated and set into their close states, and when the first feed portion and second feed portion are joined to feed toner, the first toner feed passage and the second toner feed passage are set into communication with each other by the pressing member pressing on the lever the first shutter member to cause the first shutter member and the second shutter member to integrally rotate while in contact with each other to open the first shutter member and the second shutter member.

2. The toner feed unit according to claim 1, wherein the lever has an arced shape, and the lever is located outside the first feed portion and the second feed portion when the first feed portion and the second feed portion are joined.

3. The toner feed unit according to claim 1, wherein the first toner feed passage and the second toner feed passage are formed of resin material containing a conductive substance.

4. The toner feed unit according to claim 1, wherein the surfaces of the first toner feed passage and the second toner feed passage have a ten point mean roughness Rz of 2 μm or lower.

5. The toner feed unit according to claim 1, wherein the first shutter member is provided with a sealing element.

6. An image forming apparatus forming an image by transferring a developed toner image to a recording medium and fixing the toner image thereto, comprising:

a toner cartridge for reserving toner; and a developing device for developing an electrostatic latent image formed on the photoreceptor surface with toner, characterized in that the toner feed unit according to claim 1 is used to supply toner from the toner cartridge to the developing device.

* * * * *